US005664851A

United States Patent [19]

Dunn

[11] Patent Number: 5,664,851

[45] **Date of Patent: *Sep. 9, 1997**

[54] DOCUMENT DISPLAY CASE

[76] Inventor: Gary D. Dunn, 2368 Podocarpus Way, Clearwater, Fla. 34619

[ * ] Notice: The term of this patent shall not extend beyond the expiration date of Pat. No. 5,623,778.

[21] Appl. No.: 554,807

[22] Filed: Nov. 7, 1995

[51] Int. Cl.[6] ..... A47F 3/00

[52] U.S. Cl. ..... 312/102; 312/114; 206/747; 206/769; 206/771; 206/806; 232/17; 40/312; 40/607

[58] Field of Search ..... 40/312, 585, 607, 40/611, 622, 657; 232/17, 39; 206/745, 747, 751, 769, 775, 776, 806; 312/100, 102, 114, 351.1, 351.2, 321.5, 245

[56] References Cited

U.S. PATENT DOCUMENTS

| | | | |
|---|---|---|---|
| 445,996 | 2/1891 | Iden . | |
| 454,769 | 6/1891 | Robert | 40/622 |
| 749,154 | 1/1904 | Benton | 232/45 |
| 1,153,548 | 9/1915 | Gast | 232/46 |
| 1,370,635 | 3/1921 | Draper . | |
| 1,453,658 | 5/1923 | Clough . | |
| 1,537,899 | 5/1925 | Stubbs . | |
| 2,206,848 | 7/1940 | McAvoy . | |
| 2,861,711 | 11/1958 | Schneider . | |
| 3,659,355 | 5/1972 | Aubin, Jr. . | |
| 3,666,340 | 5/1972 | Albeanese, III . | |
| 4,209,212 | 6/1980 | McGoldrick | 312/245 |
| 4,304,447 | 12/1981 | Ellwood et al. | 312/245 X |
| 4,337,590 | 7/1982 | Jackson . | |
| 5,048,900 | 9/1991 | Nunn | 312/114 |

FOREIGN PATENT DOCUMENTS

| | | | |
|---|---|---|---|
| 1018717 | 10/1957 | Germany . | |
| 2270654 | 9/1976 | Germany | 40/607 |

*Primary Examiner*—Kenneth J. Dorner
*Assistant Examiner*—Cassandra Davis
*Attorney, Agent, or Firm*—Terrance L. Siemens

[57] ABSTRACT

A weather resistant case for displaying construction permits and the like. The case has a base member and a door hinged to the base member. A tack board mounted to the rear wall of the base member supports documents being displayed. The door has a transparent window for viewing the documents. Novel features include a cylindrical internal cavity cooperatively formed between the cover and base members for holding rolled up drawings, a slot for insertion of mail or written messages, pull down latches for securing the cover, a lock for the cover, a document holder located on the inside of the cover, an external rear recess configured to steady the display case against and mount the display case on a four inch by four inch post, and a frontal area protected by being recessed, for posting notes or writing messages with ink markers. The cover hinge is a piano hinge embedded in both the cover and the base. This feature renders the cover inseparable from the base, and decreases likelihood of water penetration to the interior of the case. The display case is preferably formed by injection molding from synthetic resin, therefore being light in weight, weather resistant, and easily formed to include the above features.

15 Claims, 4 Drawing Sheets

DOCUMENT DISPLAY CASE

BACKGROUND OF THE INVENTION

1. Field of the Invention

The present invention relates to a weather resistant, lockable display case for displaying permits and related documents, and for storing small articles at a construction site: or for general posting of notices for any purpose.

2. Description of the Prior Art

The present invention improves upon the applicant's prior invention, shown in U.S. Pat. No. 4,821,440, issued on Apr. 18, 1989. Described therein is a case having a clear or transparent hinged cover and an internal tack board for securing paper documents by tacks in a visible condition. The device is intended primarily for convenient, protected display of documents which are generally required to be visible to passers by. Display of construction permits is the principal function of this device.

The use of a tack board is also shown in U.S. Pat. No. 3,659,355, issued to Adelard L. Aubin, Jr. on May 2, 1972. Aubin's enclosure lacks a lock, mail slot, pull down latches, interior document holder, and hinge construction provided in the instant invention. Also, there is no provision for mounting Aubin, Jr.'s device to a post, as is the case in the instant invention.

U.S. Pat. No. 1,370,635, issued to Talbert A. Draper on Mar. 8, 1921, features internal clips and guides for securing papers against the cover on the inside. However, Draper lacks the novel features cited above.

Pull down latches for securing a cover of a receptacle are described in U.S. Pat. No. 2,206,848, issued to Charles A. McAvoy on Jul. 2, 1940. McAvoy as well as Draper lacks the listed novel features.

A mounting arrangement employing dovetailed mating parts is described in U.S. Pat. No. 1,453,658, issued to George B. Clough on May 1, 1923. One of the mating parts has a flange drilled to accept fasteners. This part is fastened to a vertical surface. The mating part is integral with Clough's display, which is then place onto the first part such that the two parts interfit. The present invention includes a low wall for cooperating with a square cut post. This differs from Clough in that the present invention has no separable part which is mounted to the supporting vertical surface prior to mounting the display case.

A number of hinged cases are known wherein the respective sides of the hinge are formed integrally with the stationary and door members. An example is seen in U.S. Pat. No. 1,537,899, issued to Clendenon L. Stubbs on May 12, 1925. However, casting of material so as to entrap the members of the hinge as performed in the present invention is not suggested or taught.

The prior art shows some of the features of the present invention, but not in the advantageous combination of the present invention. Furthermore, the prior art is silent regarding many novel features. Therefore, none of the above inventions and patents, taken either singly or in combination, is seen to describe the instant invention as claimed.

SUMMARY OF THE INVENTION

The present invention advances the art of display cases over those already known by providing additional features and novel construction. Apart from the novel features, it is important to the invention to combine certain features such as weather resistant enclosure, viewing window, tack board, and pull down latches, since these features in combination render the inventive display case a communications center as well as merely a display case for construction permits. Although these features are individually known, their combination in a display case yields a device having far greater versatility and utility.

The novel display cases has the usual base member having a rear wall and four walls normal to the rear wall, a hinged cover including a viewing window, and a tack board for mounting a paper or document for display.

It will be appreciated that a construction project requires the cooperation of diverse trades, suppliers, municipal authorities, financial and administrative personnel, customers, craftspeople, and unaffiliated observers. Each party has varying needs to monitor the project and communicate with others. Such parties are not always at the site, and a convenient, readily recognizable location on site for storing and exchanging messages, invoices, plans, directives, and the like is greatly desirable. In response to this need, the inventive display case doubles as a communications center by incorporation of certain features such as a mail slot and a blank, flat front panel for marking messages. The mail slot receives papers and flat objects, such as keys, computer discs, electronic access cards, labels, and the like, from those who may lack access to the interior of the display case.

Among the novel features, most unique is provision of a cylindrical recess within the case. This feature accommodates storage of construction drawings, which are typically rolled up, and which typically comprise many sheets. The drawings, which are frequently referred to during construction, can thus be conveniently stored, and separated from other materials which could cause the roll to unravel, and the individual sheets to deteriorate.

A document holder within the case holds papers in an organized manner, away from other papers and materials. The cover has a lock to discourage casual theft and vandalism. Thus, the inventive display case provides a degree of security, so that organized, reliable storage of important materials is assured.

Secure construction which promotes water resistance is provided by utilizing high precision injection molding of the principal components. Members of a piano hinge are embedded within the cover and base member by embedding the same integrally within the principal components in the injection molding process. Precision of the molding technique is preserved, compared to prior art practice of bending tabs of a sheet metal enclosure to form a hinge. Also, gaps which could allow penetration of water, dust, and the like are discouraged by such construction. Furthermore, pull down latches exert a constant resilient force urging the cover closed, which thwarts the tendency of wind driven water and dust to contaminate the interior.

Injection molding of the components in a synthetic resin has additional benefits. One is that recesses and complicated structure are easily accommodated. A second is that means for mounting are readily formed in the case.

A three sided recess is defined on the rear of the display case by short walls, which are readily formed by fabrication by molding from synthetic resin. The recess is open to the rear and to the bottom, so that the display case cooperates with and is conveniently mounted on a square cut post. Preferably, a nominal four inch wide post is employed to mount the display case above the ground.

In addition to mourning to a post, the display case may be mounted to a vertical surface. A plurality of holes are provided to enable nails, screws, and like fasteners to support the display case flush to the vertical surface.

Accordingly, it is a principal object of the invention to provide a display case which offers the functions of displaying documents, providing a communications center, and enabling storage of small, incidental objects and supplies.

It is another object of the invention to maximize weather resistant characteristics.

It is a further object of the invention to provide a degree of security against theft and vandalism of objects stored onsite.

Still another object of the invention is to form the display case with precision, from a corrosion resistant material.

An additional object of the invention is to provide an internal document holder, so that stored materials are maintained in an organized fashion.

It is again an object of the invention to provide external structure cooperating with a square cut post, to expedite ready mounting of the display case above ground.

Yet another object of the invention is to provide a recess specifically configured to cooperate with rolled up drawings.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
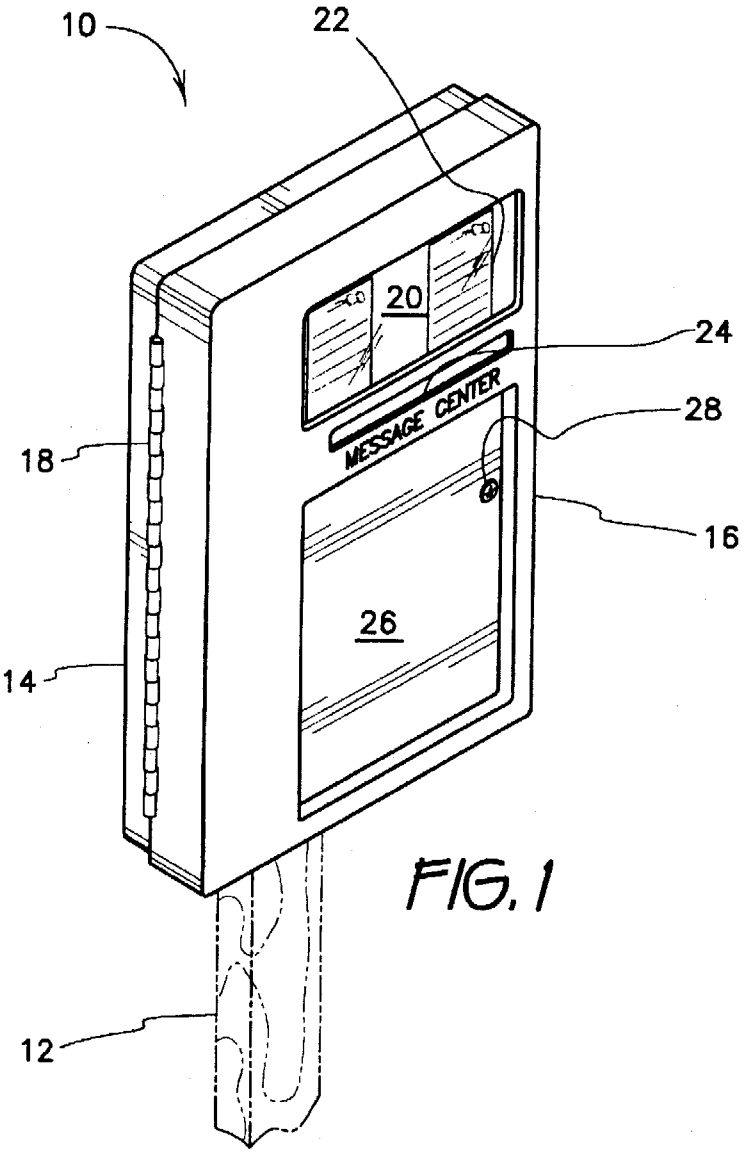
FIG. 1 is an environmental, perspective view of the invention.

Turning now to FIG. 1 of the drawings, the novel display case 10 is shown mounted on a nominal four by four inch square cut post 12. Case 10 has a base member 14 and a door or cover 16 pivotally attached to base 14 by piano hinge 18 (of course other types of hinges could be used). Cover 16 is movable from the closed position depicted to an open position. Cover 16 overlaps base member 14 so as to act in the capacity of a partial weather hood when closed. Of course, base member 14 could overlap cover 16 to the same effect, if desired.

Cover 16 has a transparent or translucent window 20 for viewing documents 22 contained within case 10, a permanently open slot 24 for receiving mail and other small or flat objects (not shown), a recessed flat frontal external surface or area 26 for posting of information, and a lock 28. Area 26 is recessed to protect its smooth surface from incidental damage when case 10 is being moved and stored between uses.

Figure 2:
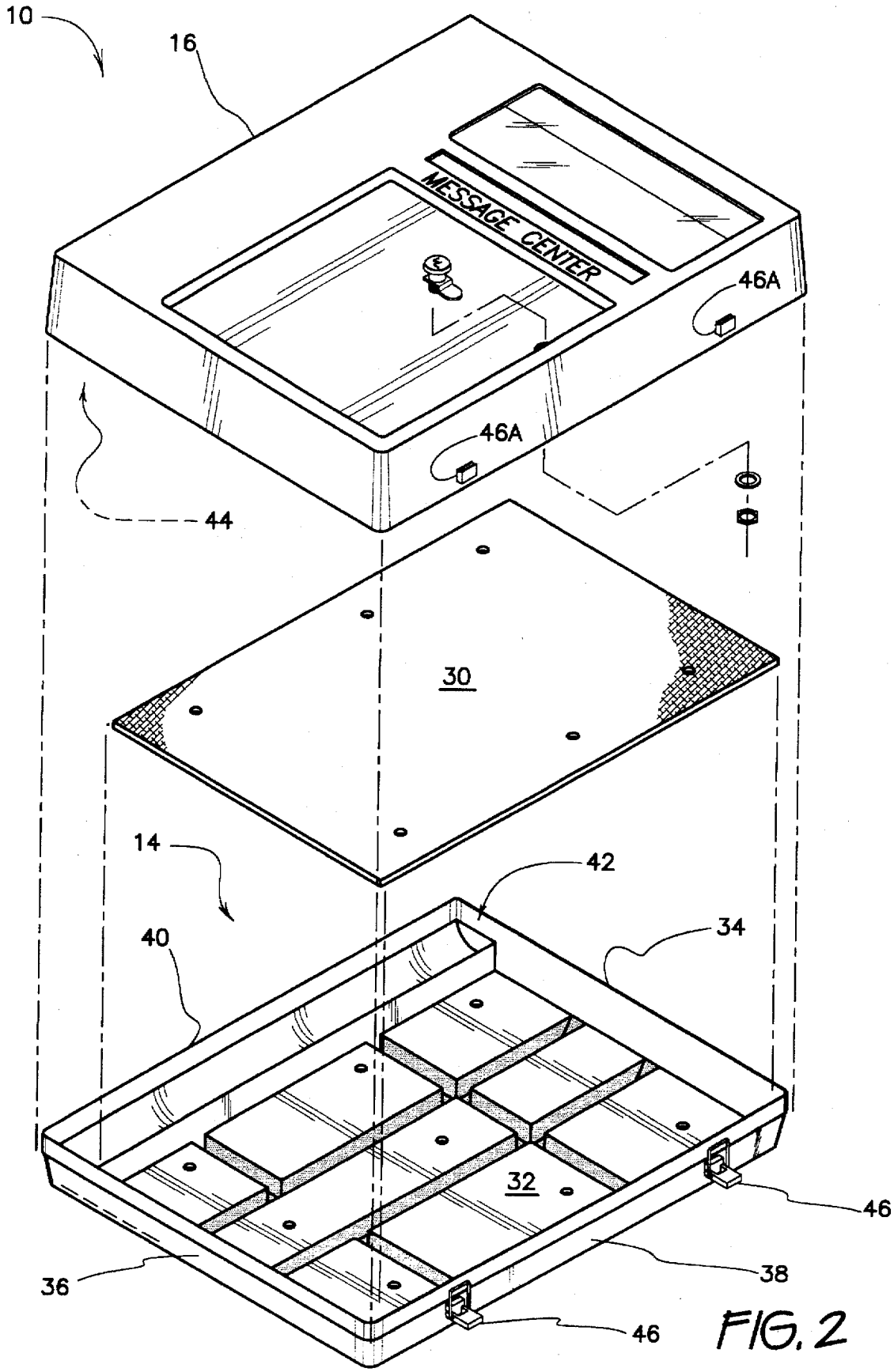
FIG. 2 is an exploded, front perspective view of the invention.

FIG. 2 shows the interior of case 10. A tack board 30 is secured to the rear wall 32 of base member 14. Tack board 30 receives pins or tacks (not shown) for securing papers to tack board 30. Other devices for securing a paper within view from window 20 could also be employed. For example, a surface coated with a non-drying adhesive could be provided. The important characteristic is that a paper must be releasably secured behind window 20.

Base member 14 also has top and bottom walls 34,36, respectively, and right and left lateral walls 38,40, respectively. A semi-cylindrical recess 42 is formed in base member 14, and complements a similar, opposed recess 44 formed in cover 16. FIG. 2 indicates only the location of recess 44 within cover 16. Recess 44 is fully shown in FIG. 5. When cover 16 is closed, the complementary recesses collectively define a cylindrical recess for receiving and storing rolled blueprints or drawings (not shown). Although an uninterrupted, full semi-cylindrical recess is depicted, strict adherence to this configuration is not required. Enough of the cylindrical surface must be present to maintain a generally cylindrical roll of paper upright and within the combined recesses 42,44 when cover 16 is closed.

Also shown in this view are the locking cylinder and tongue of lock 28, and two pull down latches 46. Pull down latches 46 exert a resilient force urging cover 16 tightly into the closed position. This is advantageous in maintaining weather resistant qualities of case 10. Other latches providing the same characteristics could be substituted for pull down latches 46. However, it is preferred to employ latches which have no components separable from case 10, and which do not require tools to operate. Pull down latches 46 can be fixed either to base member 14 or to cover 16, and engage a projection 46A formed on the other respective member 16 or 14.

Figure 3:
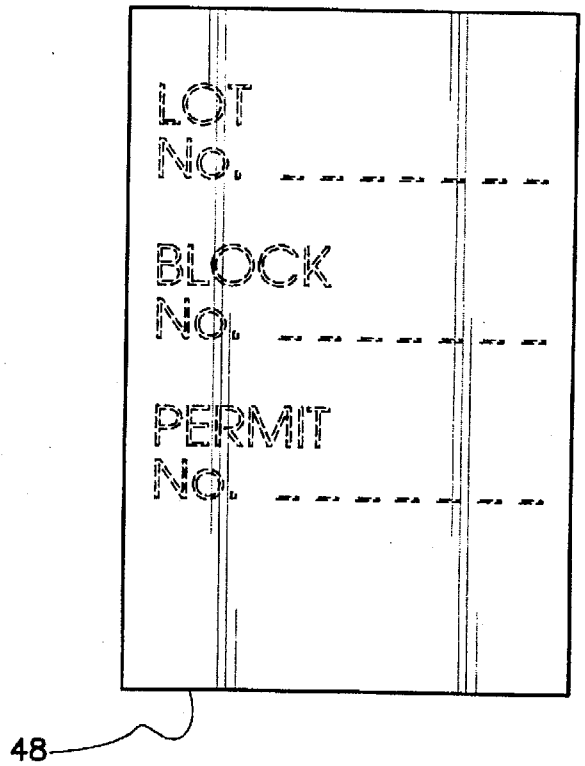
FIG. 3 is front elevation view of a decal which is affixed to the front of the invention in some applications.

The large recessed area 26 on the front of cover 16 is provided in order to post messages. Preferably, a decal 48, shown in FIG. 3, is provided. Decal 48 is preprinted with certain notations of significance to building contractors, or to others employing display case 10. Should decal 48 be mined or worn beyond the point of being usable, an additional decal can be adhere thereover. It is intended that readily erasable media, such as grease pencils, be employed to mark decal 48. To maintain the smooth surface of area 26, it is recessed to prevent damage from abrasion and the like when case 10 is being transported, stored, and otherwise handled. Abrasion and scratching of the surface will tend to render decals less susceptible to being readily erased.

Figure 4:
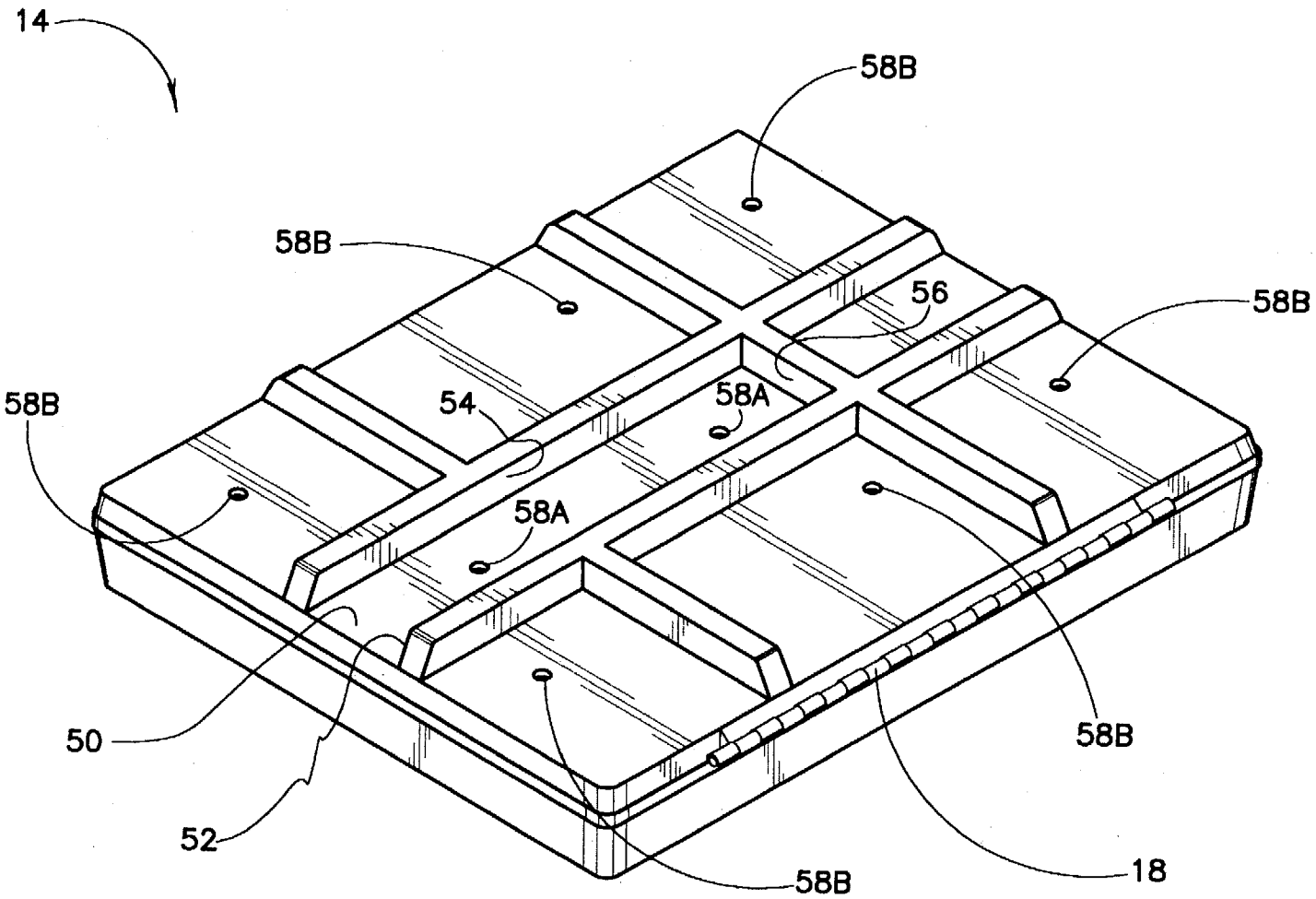
FIG. 4 is a rear perspective view of the invention.

Turning now to FIG. 4, base member 14 is seen to include on its rear side low walls defining a downwardly and rearwardly open recess 50. Walls need not be formed, as long as recess 50 has right, left, and top surfaces 52,54,56, respectively, for cooperating with and partially surrounding a square cut post 12 (see FIG. 1). Recess 50 enables case 10 to be positioned on a post 12 so that fasteners may be driven into post 12 through holes 58A. Additional holes 58B are provided for mounting case 10 on a flush vertical surface, when that may be desired.

Figure 5:
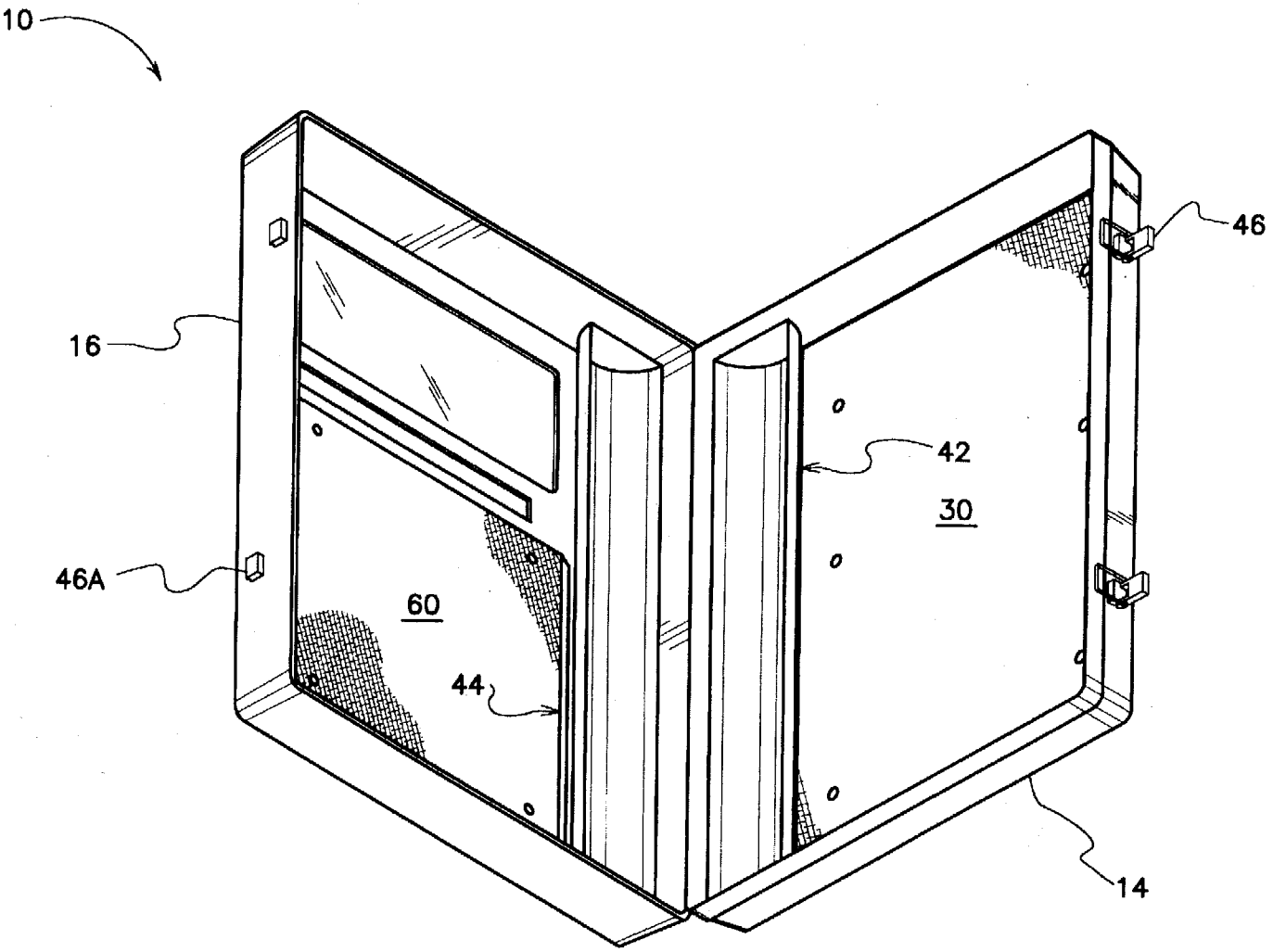
FIG. 5 is a front perspective view of the invention, shown with the cover open to reveal internal detail.

In this view of piano hinge 18, it will be noted that only the circular members of hinge 18 are visible. The flange portions (not visible in this view) of hinge 18, normally affixed to the stationary and movable members of an enclosure by fasteners, are in the present invention embedded within the walls of base member 14 and cover 16. This is accomplished by fabricating case 10 by injection of synthetic resin into a mold, with the hinge flanges set in place within the void of the mold. FIG. 5 shows case 10 assembled, with cover 16 swung into an open position to reveal the interior of case 10. A document holder 60 is located on the rear of cover 16, within the interior of case 10. Document holder 60 may be a second tack board, as depicted, or may be a pocket (not shown). The precise nature of document holder 60 is not critical as long as papers (not shown) may be stored therein parallel to the front of cover 16, and separated from other materials and papers which may be stored within case 10.

Thus it will be seen that a display case is set forth which advances the purposes beyond merely displaying a paper document in a sheltered device. The novel display case receives and stores many construction related objects, and serves to facilitate communication among the many parties to the construction process. The novel display case is rust and corrosion resistant, light in weight when fabricated from synthetic resin, and readily formed to incorporate the many individual construction features set forth above. Of course, variations on the specific features will occur to those of ordinary skill in the art. For example, it would be possible to fabricate the display case wholly or partially from metal. Also, the recessed frontal area may be transparent or translucent to increase the viewable area, if desired.

It is to be understood that the present invention is not limited to the embodiments described above, but encompasses any and all embodiments within the scope of the following claims.

I claim:

1. A weather resistant document display case comprising:.

a base member having a rear wall, a top wall projecting forwardly from said rear wall, a right lateral wall and a left lateral wall projecting forwardly from said rear wall, and a bottom wall projecting forwardly from said rear wall;

a cover member pivotally attached to said base member, said cover member having a window for revealing contents of said display case, and being movable to a closed position and to an open position, said cover member and said base member being in overlapping relationship to one another when said cover member is in said closed position;

a hinge attached to said base member and to said cover member providing pivoting connection between said base member and said cover member;

a tack board mounted to said display case parallel to said rear wall, for supporting documents affixed to said tack board; and a lock releasably securing said cover member in said closed position, said base member and said cover member having complementary internal surfaces dimensioned and configured to define a cylindrical recess, for receiving and surrounding a cylindrical object placed therein.

2. The display case according to claim 1, said cover member further comprising means defining a slot therein for receiving and storing flat objects inside said display case.

3. The display case according to claim 1, said base member further comprising a rearly oriented surface and means defining a downwardly and rearwardly open recess formed at said rearly oriented surface of said base member, for cooperating with and partially surrounding a post which post is optionally provided and utilized for purposes of mounting said display case, whereby said display case is positioned with respect to the post when the post is provided for mounting said display case above the ground.

4. The display case according to claim 1, said hinge having a first section embedded within said base member and a second section embedded within said cover member.

5. The display case according to claim 1, further comprising at least one pull down latch attached to said base member and to said cover member so as to clasp said cover member to said base member, thereby maintaining said cover member in said closed position.

6. The display case according to claim 1, said front cover having a rear side and a front side, and further comprising a document holder located on said rear side of said front cover, for storing papers within said display case parallel to said front side of said cover member.

7. The display case according to claim 1, said cover member further comprising a recessed front external surface located apart from said window, said recessed front external surface for providing a surface in a sheltered yet visible location for receiving messages written directly on said recessed front external surface and adhered to said recessed front external surface.

8. The display case according to claim 1, said base member further comprising means defining holes formed in said rear wall for receiving fasteners, whereby said display case is mountable on a vertical surface.

9. The display case according to claim 1, fabricated by molding synthetic resin, whereby said display case is rust and corrosion resistant, and light in weight.

10. A weather resistant document display case comprising:

a base member having a rear wall, a top wall projecting forwardly from said rear wall, a right lateral wall and a left lateral wall projecting forwardly from said rear wall, and a bottom wall projecting forwardly from said rear wall, and a rearly oriented surface having means defining a downwardly and rearwardly open recess formed at said rearly oriented surface of said base member, for cooperating with and partially surrounding a post, whereby said display case is adapted to be positioned adjacent to the post when the post is provided for mounting said display case above the ground;

a cover member pivotally attached to said base member, said cover member having a window for revealing contents of said display case and means defining a slot therein for receiving and storing flat objects inside said display case, and being movable to a closed position and to an open position, said cover member and said base member being in overlapping relationship to one another when said cover member is in said closed position, said base member and said cover member having complementary internal surfaces dimensioned and configured to define a cylindrical recess, for receiving and surrounding a cylindrical object placed therein;

a hinge attached to said base member and to said cover member providing pivoting connection between said base member and said cover member;

a tack board mounted to said display case parallel to said rear wall, for supporting documents affixed to said tack board;

at least one pull down latch for maintaining said cover member in said closed position; and a lock releasably securing said cover member in said closed position.

11. The display case according to claim 10, said hinge having a first section embedded within said base member and a second section embedded within said cover member.

12. The display case according to claim 10, said front cover having a rear side and a front side, and further comprising a document holder located on said rear side of said front cover, for storing papers within said display case parallel to said front side of said cover member.

13. The display case according to claim 10, said cover member further comprising a recessed front external surface located apart from said window, said recessed front external surface for providing a surface in a sheltered yet visible location for receiving messages written directly on said recessed front external surface and adhered to said recessed front external surface.

14. The display case according to claim 10, said base member further comprising means defining holes formed in said rear wall for receiving fasteners, whereby said display case is mountable on a vertical surface.

15. The display case according to claim 10, fabricated by molding synthetic resin, whereby said display case is rust and corrosion resistant, and light in weight.

* * * * *